US007434324B2

(12) United States Patent
McKenna

(10) Patent No.: US 7,434,324 B2
(45) Date of Patent: Oct. 14, 2008

(54) TOOL FOR QUALITATIVELY MEASURING A FEATURE OF A SKATE BLADE

(76) Inventor: James McKenna, 24825 Little Mack, St. Clair Shores, MI (US) 48080

( * ) Notice: Subject to any disclaimer, the term of this patent is extended or adjusted under 35 U.S.C. 154(b) by 0 days.

(21) Appl. No.: 11/701,594

(22) Filed: Feb. 2, 2007

(65) Prior Publication Data

US 2007/0186428 A1 Aug. 16, 2007

Related U.S. Application Data

(63) Continuation-in-part of application No. 11/238,816, filed on Sep. 29, 2005, now abandoned.

(51) Int. Cl.
*G01B 5/24* (2006.01)

(52) U.S. Cl. ..... 33/474; 33/535

(58) Field of Classification Search ..... 33/474, 33/535

See application file for complete search history.

(56) References Cited

U.S. PATENT DOCUMENTS

| | | | | |
|---|---|---|---|---|
| 1,639,580 | A | 8/1927 | Thompson | |
| 3,730,631 | A | 5/1973 | Streander | |
| 5,345,688 | A | 9/1994 | Allen | |
| 5,361,504 | A | 11/1994 | Huang | |
| 5,547,416 | A | 8/1996 | Timms | |
| 6,481,113 | B1 | 11/2002 | Brenner et al. | |
| 6,594,914 | B1 | 7/2003 | Babcock | |
| 6,729,033 | B2 | 5/2004 | Jevons et al. | |
| 6,996,911 | B1 | 2/2006 | Dinius | |
| 7,191,539 | B2 * | 3/2007 | Zukerman | 33/535 |
| 2005/0188558 | A1 | 9/2005 | Zukerman | |
| 2005/0188588 | A1 | 9/2005 | Keng | |

* cited by examiner

*Primary Examiner*—Christopher W Fulton
(74) *Attorney, Agent, or Firm*—Reising, Ethington, Barnes, Kisselle, P.C.

(57) ABSTRACT

A tool for qualitatively measuring a feature of a skate blade.

41 Claims, 12 Drawing Sheets

TOOL FOR QUALITATIVELY MEASURING A FEATURE OF A SKATE BLADE

CROSS-REFERENCE TO RELATED APPLICATIONS

This application is a continuation-in-part of U.S. patent application Ser. No. 11/238,816 filed on Sep. 29, 2005 now abandoned.

FIELD OF THE INVENTION

The present invention relates to a tool for qualitatively measuring a feature of a skate blade, and more particularly to a tool for qualitatively measuring whether a skate blade has been sharpened to the correct radius of hollow and/or the profile of the sharpened surface has been properly centered with respect to the blade.

BACKGROUND OF THE INVENTION

Figure skaters, hockey players, and speed skaters utilize skates with a blade that must be sharpened from time to time. Typically, the skate blades are sharpened utilizing a machine that has a rotating stone and an arcuate shaped outer surface for sharpening a skate blade. The radius of the arcuate shaped outer surface of the stone may be varied to produce different depths of hollow in the skate blade or different stones with different radii of the arcuate shaped outer surface may be used. Rarely are skate blades sharpened so that the sharpened surface is substantially flat and perpendicular with the side faces of the skate blade. Instead, the skate blade surface is sharpened in a concaved shape so that a portion of the blade is hollowed out. This produces two sharp edges. Typically, skaters who desire the ability to turn sharply have their skates sharpened to produce a larger depth of hollow. Skaters that wish to skate fast or to spin more freely have their skates sharpened so that the sharpened surface profile has a relatively smaller depth of hollow.

Devices have heretofore been known to make quantitative measurements of the depth of hollow of a sharpened skate blade. A known depth of hollow indicator tool available from Edge Specialties, Inc. makes such a quantitative measurement of the depth of hollow. This depth of hollow tool includes a probe which makes a precise linear quantitative measurement of the depth of hollow of a sharpened skate surface. This tool is relatively bulky and relatively expensive, selling for approximately $225.00. Another tool for quantitatively measuring the depth of hollow is available from Maximum Edge of Windsor, Ontario and sells for approximately $150.00. This other tool is also relatively bulky and is not easily carried by the owner.

The present invention provides alternatives to the prior art.

SUMMARY OF THE INVENTION

A tool for qualitatively measuring a feature of a skate blade. One embodiment of the invention includes a means for qualitatively determining whether a skate blade has been sharpened properly. In one embodiment of the invention, the means for qualitatively determining whether a skate blade has been sharpened properly includes a means for determining whether a skate blade has been sharpened squarely, that is, whether the profile of the sharpened surface has been properly centered with respect to the side faces of blade. In one embodiment of the invention, the means for qualitatively determining whether a skate blade has been sharpened properly includes a radius of hollow indicator means. In another embodiment of the invention, the means for qualitatively determining whether a skate blade has been sharpened properly includes both a means for determining whether a skate blade has been sharpened squarely, and at least one radius of hollow indicator means.

Other embodiments of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The present invention relates to a tool for qualitatively measuring a feature of a skate blade, and more particularly to a tool for qualitatively measuring whether a skate blade has been sharpened to the correct radius of hollow and for the profile of the sharpened surface has been properly centered with respect to the blade. One embodiment of the invention includes a means for qualitatively determining whether a skate blade has been sharpened properly. In one embodiment of the invention, the means for qualitatively determining whether a skate blade has been sharpened properly includes a means for determining whether a skate blade has been sharpened squarely, that is, whether the profile of the sharpened surface has been properly centered with respect to the side faces of blade. In one embodiment of the invention, the means for qualitatively determining whether a skate blade has been sharpened properly includes a radius of hollow indicator means. In another embodiment of the invention, the means for qualitatively determining whether a skate blade has been sharpened properly includes both a means for determining whether a skate blade has been sharpened squarely, and at least one radius of hollow indicator means.

Figure 1:
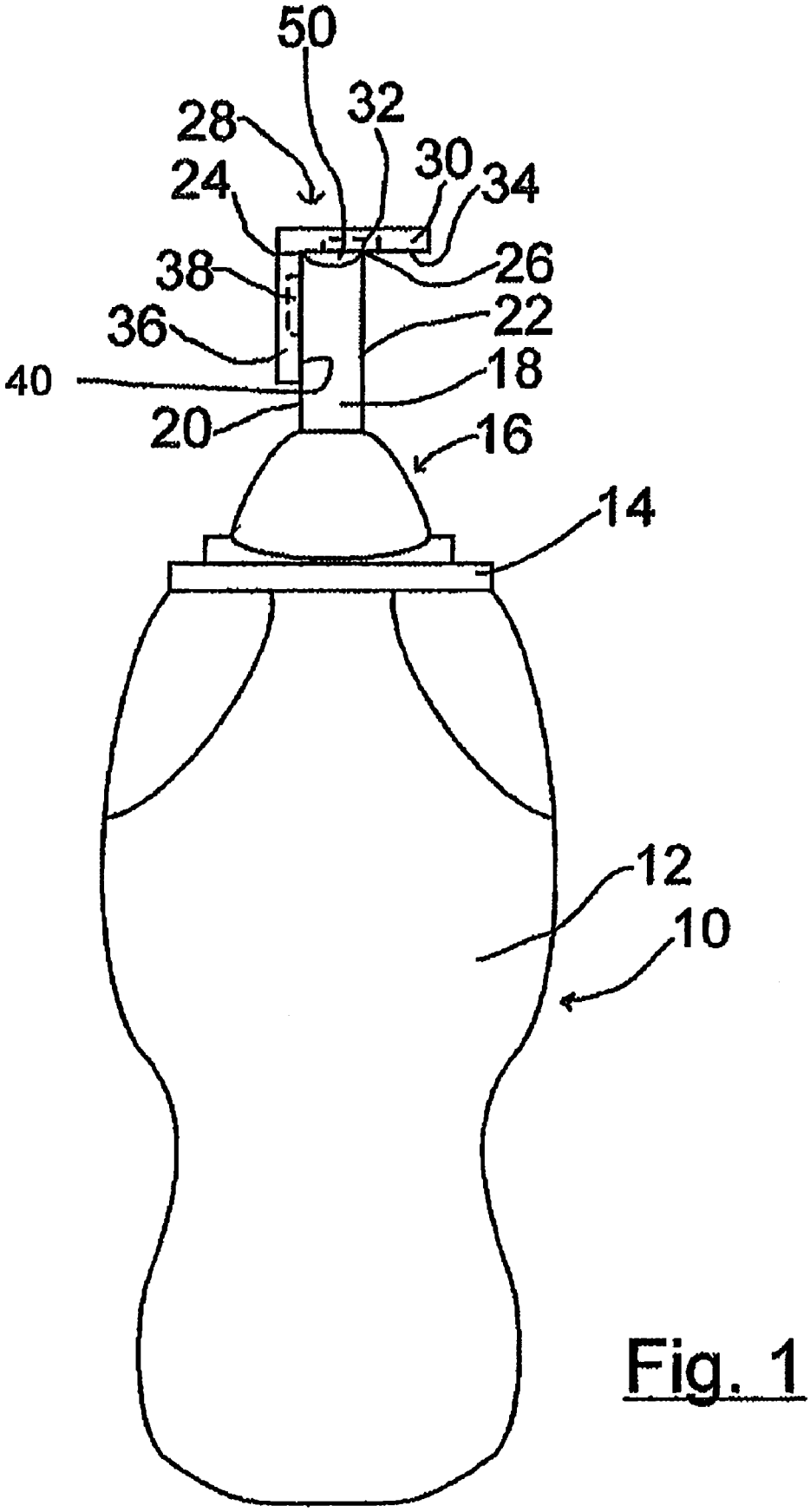
FIG. 1 illustrates a skate having a blade and a tool for qualitatively measuring a feature of the skate blade.

FIG. 1 illustrates a skate 10 including a boot 12 and a sole 14 attached thereto. A blade holder 16 is attached to the sole 14 by rivets (not shown) and a blade 18 is attached to the blade holder 16. Blade 18, typically includes a metal such as stainless steel, and has a first side face 20 and an opposite second side face 22. Blade 18 includes a surface 50 for sharpening and skating thereon. Surface 50 is typically hollow ground to provide a first sharp edge 24 at the free end of the first face 20 of the blade and a second sharp edge 26 at the free end of the second face 22 of the blade 18. According to one embodiment of the invention, a tool 28 for qualitatively measuring a feature of the skate blade including both a means for determining whether a skate blade has been sharpened squarely, and at least one radius of hollow indicator means. The tool 28 is positioned to qualitatively measure whether the hollow ground sharpening of the surface 50 of the blade 18 has been properly centered with respect to the blade 18. The tool 28 may include a first leg 30 having a first substantially flat reference face 34. The first leg 30 may have a length of about 2 inches to about 6 inches. For example, the first leg 30 may be 3 inches long. The first leg 30 may also include a first magnet 32 which may include a portion forming a part of the first substantially flat reference face 34. The tool 28 may also include a second leg 36 including a second substantially flat reference face 40. The second leg 36 may have a length of about 2 inches to about 6 inches. For example, the second leg 36 may be 3 inches long. The second leg 36 may also include a second magnet 38 including a portion that forms part of the second substantially flat reference face 40. The first substantially flat reference face 34 and the second substantially flat reference face 40 form a right angle, that is are positioned perpendicular to each other but not necessarily engaging each other. The first leg 30 and the second leg 36 may be made of any of a variety of materials including, but not limited to, metal, wood, plastic, thermoset and other polymeric materials. The first leg 30 and the second leg 36 may be constructed and arranged to balance on the skate blade 18.

Figure 2:
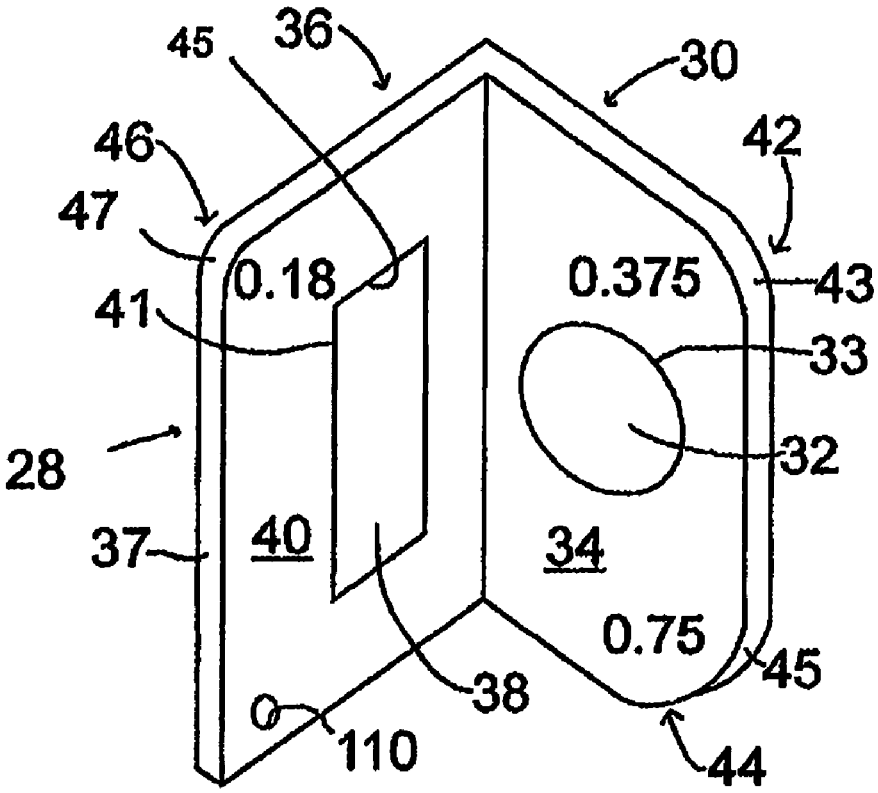
FIG. 2 is a perspective view of one embodiment of the invention including a tool for measuring a feature of a skate blade.

Referring now to FIG. 2, one embodiment of the invention includes a tool for qualitatively measuring a feature of a skate blade including both a means for determining whether a skate blade has been sharpened squarely, and at least one radius of hollow indicator means. The tool 28 includes a first leg 30 having a first substantially flat reference face 34. In this embodiment, the first magnet 32 is received in a first recess 33 so that a portion of the first magnet 32 forms part of the first substantially flat reference face 34. Alternatively, the first magnet may be embedded in the first leg 30. The first leg 30 may include a first radius of hollow indicator means 42 which may include a side edge 43 formed in an arcuate shape. The first radius of hollow indicator means 42 may be formed, for example, at a first corner of the first leg 30. The radius of the arcuate shaped edge surface 43 may be a first length corresponding to a first predetermined (or reference) radius of hollow. A marking (such as a number or writing) may be provided on the tool adjacent the first radius of hollow indicator means 42 to indicate the size of the radius of hollow or radius of hollow) to be qualitatively measured by the first radius of hollow indicator means 42. Similarly, a second radius of hollow indicator means 44 may be formed at a second corner of the first leg 30 and includes an edge surface 46 formed in an arcuate shape. The radius of the arcuate shaped surface 45 is equal to or substantially the same as the radius of a second predetermined radius of hollow.

The tool 28 may include a second leg 36 having a second substantially flat reference face 40. The second leg 36 may include a second magnet 38 which may be received in a second recess 41 so that a portion of the second magnet 38 forms part of the second substantially flat reference face 40. Alternatively, the second magnet may be embedded in the second leg 36. Although the tool 28 is shown with two magnets 32, 38, a tool according to the present invention may have 0, 1, 2 or more magnets.

As shown in FIG. 2, a third radius of hollow indicator means 46 may be provided at a first corner of the second leg 36 and includes an edge surface 47 formed in an arcuate shape. The radius of the arcuate shaped edge surface 47 is equal or substantially the same as the radius of a third predetermined radius of hollow. The second leg 36 may include a bottom edge 37. In one embodiment the second magnet 38 may be positioned near the bottom edge 37 of the second leg 36. A third marking may be formed on a tool adjacent the third radius of hollow indicator means 46 to indicate the radius of hollow to be measured by the third radius of hollow indicator means 46. In one embodiment of the invention, a through-hole 110 is provided near a second corner of the second leg 36. A key chain or loop may extend through the through-hole 110.

Figure 3:
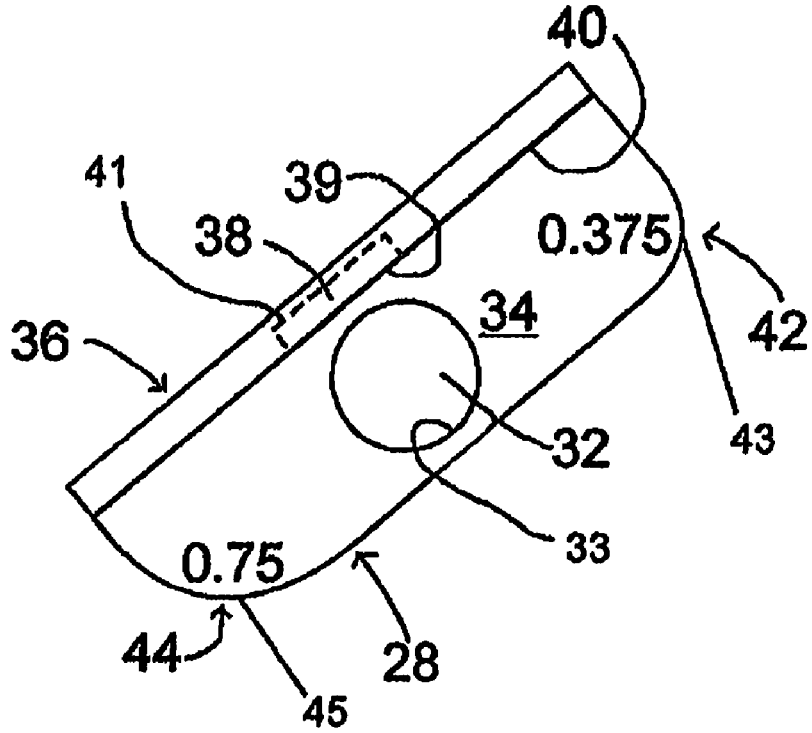
FIG. 3 is a side view of the tool shown in FIG. 2.

FIG. 3 is a side view of the tool 28 shown in FIG. 2 and illustrates a portion 39 of the second magnet 38 forming part of the second substantially flat reference face 40 of the second leg 36.

Figure 4:
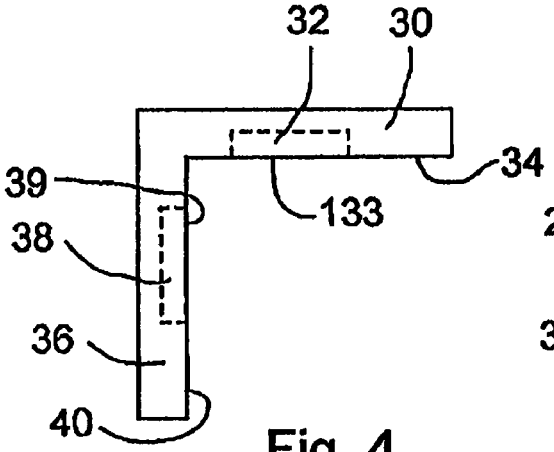
FIG. 4 is an end view of the tool shown in FIG. 2.

FIG. 4 is an end view of the tool 28 shown in FIG. 2 and illustrates a portion 133 of the first magnet 32 forming part of the first substantially flat reference face 34 of the first leg 30.

Figure 5:
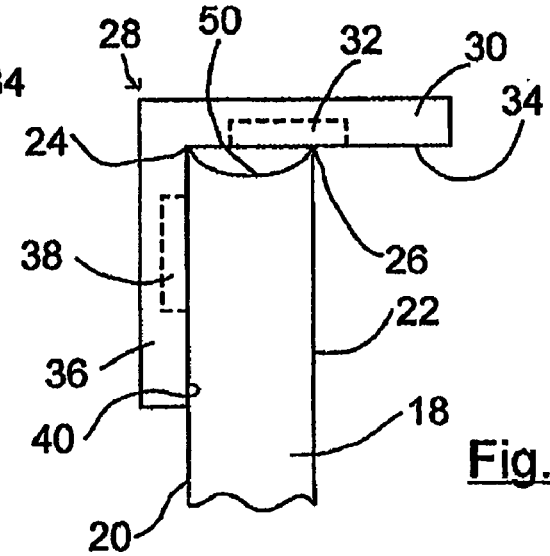
FIG. 5 is an enlarged view of a skate blade with portions removed and a tool qualitatively for measuring a feature of a skate blade according to one embodiment of the invention.

Referring now to FIG. 5, when the blade 18 is sharpened by hollow grinding, the sharpened surface 50 has a concaved shape. The tool 28 for qualitatively measuring a feature of the skate blade including a means for determining whether a skate blade has been sharpened squarely may be utilized to determine whether the concaved surface 50 is properly centered with respect to the first side face 20 and second side face 22 of the blade 18. The tool 28 is placed over the blade 18 so that the second substantially flat reference face 40 engages and is flushed with one of the first or second side faces 20, 22 of the blade 18. If the first substantially flat reference face 34 engages both of the first edge 24 and the second edge 26 of the blade 18 while the second substantially flat reference face 40 is flushed with one of the first or second faces 20, 22 of the blade 18, the skate has been properly sharpened so that the concaved surface 50 is centered with respect to the first face 20 and the second face 22 of the blade 18.

Figure 6:
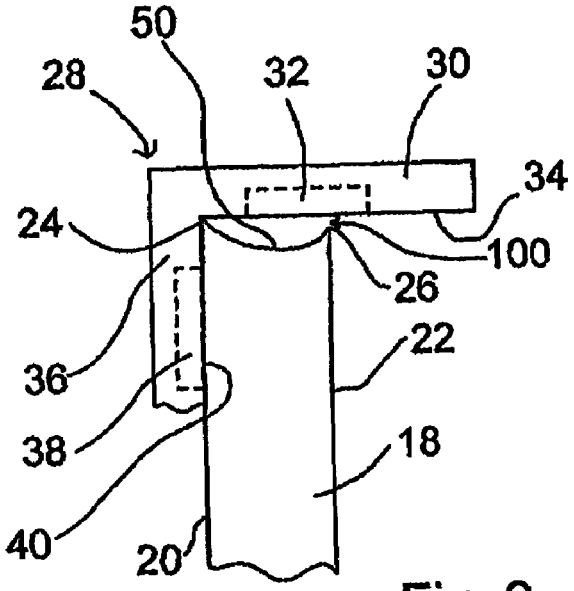
FIG. 6 is an enlarged view of a skate blade and a tool for qualitatively measuring a feature of a skate blade, according to one embodiment of the invention, showing a gap between a reference face of the tool and an edge of the blade when the hollow ground sharpening of the blade is not centered properly.

FIG. 6 illustrates a skate blade 18 which has not been properly sharpened and wherein the concaved surface 50 is not centered with respect to the first face 20 and second face 22 of the skate 18, but is skewed towards the second face 22. When the tool 28 is positioned so that the second substantially flat reference face 40 engages and is flushed with one of the first face 20 or second face 22 of the blade 18, the first substantially flat reference face 34 engages only the first edge 24 of the skate and not the second edge 26 so that a gap 100 exists between the second edge 26 and the first substantially flat reference face 34. The gap 100 can be easily seen when the tool 28 and the skate blade 18 is aligned with the eye of an observer and a backlight.

Figure 7:
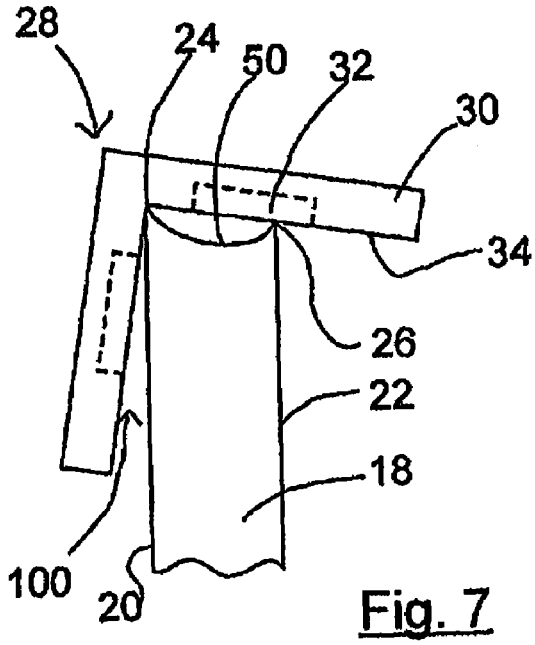
FIG. 7 is an enlarged view of a skate blade and a tool for qualitatively measuring a feature of the skate blade, according to one embodiment of the invention, showing a gap between a second reference face and the side face of a blade when the hollow ground sharpening of the blade is not properly centered.

Referring now FIG. 7, the tool 28 may be positioned so that the first substantially flat reference face 34 engages both of the edges 24 and 26 of the blade 18 and if the skate has been improperly sharpened so that the concaved surface 50 is not centered with respect to the first face 20 and the second face 22 of the blade 18, a gap 100 will exist between the second substantially flat reference face 40 and the first side face 20 (or second side face 22) of the skate 18.

Figure 8:
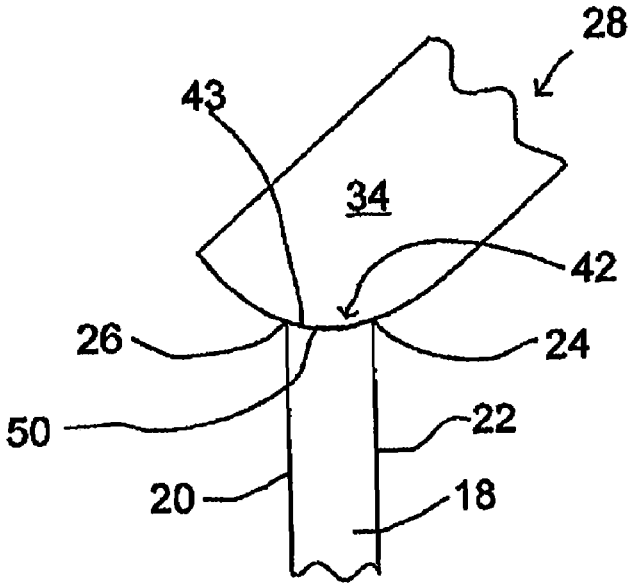
FIG. 8 illustrates, according to one embodiment of the invention, a tool for qualitatively measuring a feature of the blade, wherein the tool includes a radius of hollow indicator means.

Referring now to FIG. 8, one embodiment of the invention includes a means for qualitatively determining whether a skate blade has been sharpened properly and includes at least one radius of hollow indicator means. The tool 28 according to such an embodiment of the invention may be utilized to qualitatively determine whether a skate blade 18 has been sharpened to the proper radius of hollow. In this case, a first radius of hollow indicator means 42 is inserted into the hollow of the sharpened skate 18. If the skate 18 has been properly sharpened to a predetermined radius of hollow, the arcuate shaped surface 43 of the first radius of hollow indicators means 42 will engage the concaved surface 50 along the entire length of the concaved surface 50 across the width of the skate blade 18. FIG. 8 illustrates a skate blade 18 that has been properly sharpened to a radius of hollow corresponding to the first radius of hollow indicator means 42.

Figure 9:
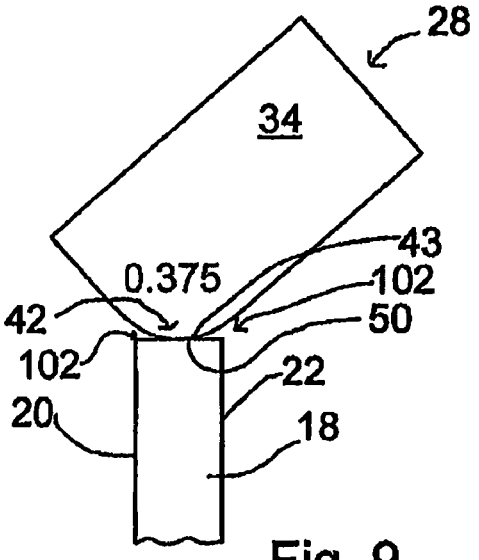
FIG. 9 illustrates the use of a tool for qualitatively measuring a feature of a skate blade, according to one embodiment of the invention, wherein a radius of hollow indicator means does not match the profile of the sharpened surface of a skate and gaps exist between the radius of hollow indicator means and the sharpened surface.

FIG. 9 illustrates a skate blade 18 which has been sharpened improperly and so that the sharpened surface 50 is too flat. In this case, the first radius of hollow indicator means 42 only engages a portion of the sharpened surface 50 and gaps 102 exist between the arcuate shaped surface 43 of the first indicator means 42 and the sharpened surface 50.

Figure 10:
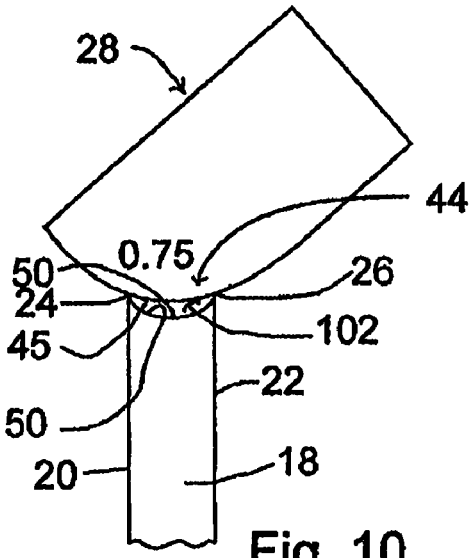
FIG. 10 illustrates a tool for qualitatively measuring a feature of a skate blade, according to one embodiment of the invention, and wherein a radius of hollow indicator means does not match the profile of the sharpened surface of a skate.

FIG. 10 illustrates a skate that has been sharpened so that the depth of hollow is greater than desired. Here a second radius of hollow indicator means 44 includes an arcuate shaped surface 45 which engages each of the first edge 24 and second edge 26 of the skate blade 18 and so that a gap 102 exist between the arcuate shaped surface 45 and the concaved shaped surface 50 of the sharpened skate blade 18.

Figure 11:
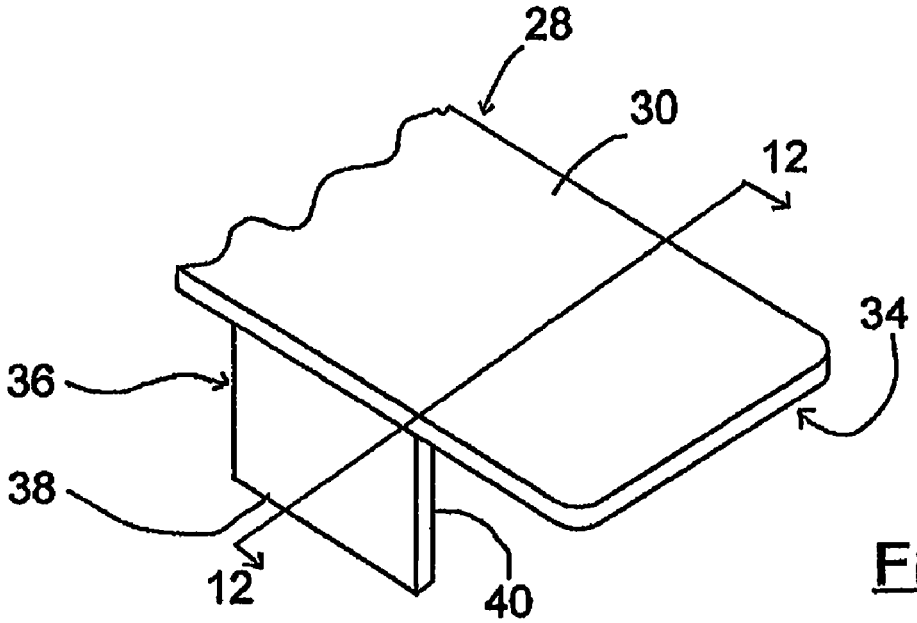
FIG. 11 illustrates a tool for qualitatively measuring a feature of a skate blade, according to one embodiment of the invention.
Figure 12:
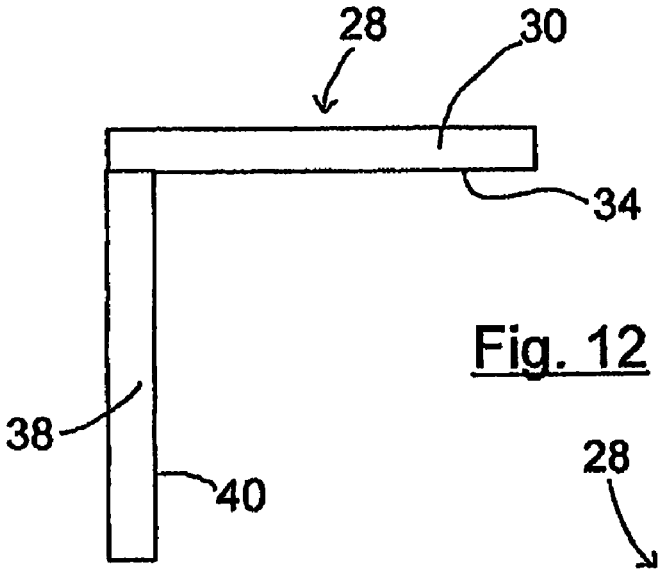
FIG. 12 is sectional view of the tool taken along line 12-12 of FIG. 11.

The scope of the present invention is not limited to the above-described embodiments. Referring now to FIG. 11, another embodiment of the invention includes a means for qualitatively determining whether a skate blade has been sharpened properly (tool 28) and includes a means for determining whether a skate blade has been sharpened squarely. In this embodiment, the second leg 36 of the tool 28 consists essentially of a magnet 38 having a second substantially flat face 40. The magnet 38 is connected directly to the first leg 30 of the tool, for example, using an adhesive (not shown) or by pressure fit. FIG.12 is a sectional view taken along the line 12-12 of FIG. 11 and shows one embodiment of attaching the magnet 38 to the first leg 30 of the tool 28. In the embodiment illustrated by FIGS. 11-12, the first leg does not include a magnet. The second magnet 38 may be sufficient to hold the tool 28 against one of the first side face 20 or second side face 22 of the skate blade 18 in order to determine whether the skate has been properly sharpened so that the concaved surface 50 is centered with respect to the first face 20 and the second face 22 of the skate blade 18.

Figure 13:
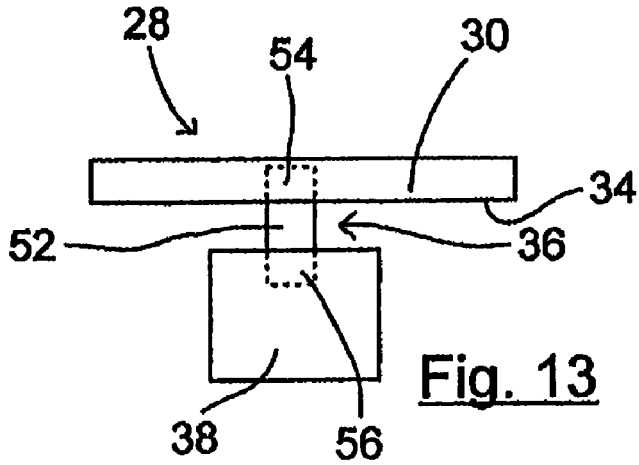
FIG. 13 illustrates another embodiment of a tool for qualitatively measuring a feature of a skate blade.

FIG. 13 illustrates another embodiment of the present invention including a means for qualitatively determining whether a skate blade has been sharpened properly (tool 28) and includes a means for determining whether a skate blade has been sharpened squarely. In this embodiment, the second leg 36 comprises a post 52 having a first end 54 attached to the first leg 30 of the tool 28. A second end 56 of the post 52 is attached to the second magnet 38. The post 52 may be constructed of a variety of materials including, but not limited to, metal, wood, plastic, thermoset or other polymeric materials.

Figure 14:
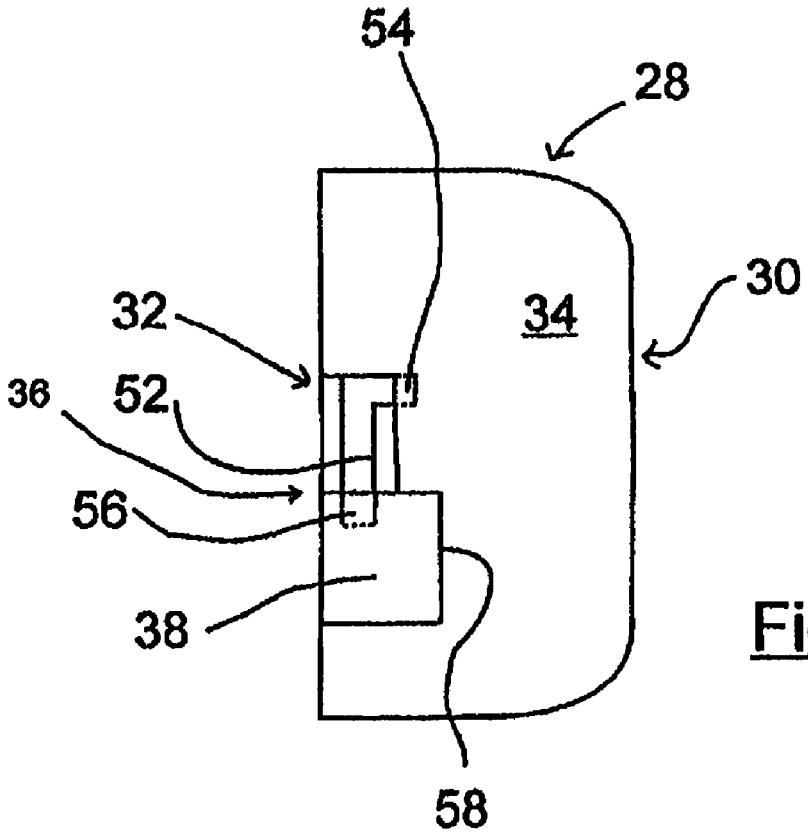
FIG. 14 illustrates another embodiment of the invention including a tool for qualitatively measuring a feature of the skate blade including a pivotally mounted second leg received in a pocket of a first leg of the tool.

FIG. 14 illustrates another embodiment of the present invention including a means for qualitatively determining whether a skate blade has been sharpened properly (tool 28) and includes a means for determining whether a skate blade has been sharpened squarely. In this embodiment, the tool 28 includes a first leg 30, and a second leg 36 that includes a post 52 having a first end pivotally connected to the first leg 30 and a second end 56 pivotally connected to the second magnet 38.

A portion of the post 52 and the magnet 58 are received in a pocket 58 formed in the first leg 30 so that the tool 28 can be folded and carried in a shirt, coat or pants pocket in a substantially flat configuration.

Figure 15:
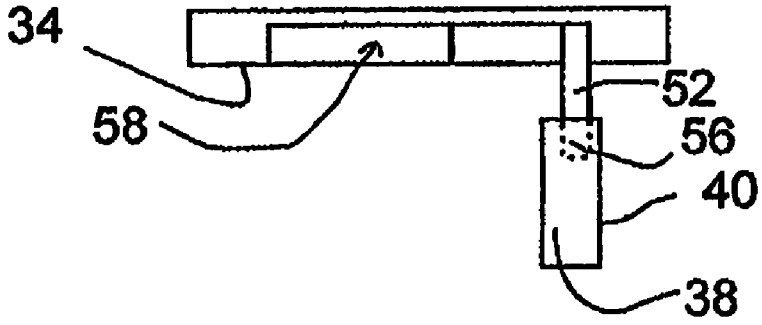
FIG. 15 illustrates a tool as shown in FIG. 14 but with the second leg extended out of the pocket of a first leg of the tool, and wherein the second leg includes a magnet in a first position.
Figure 16:
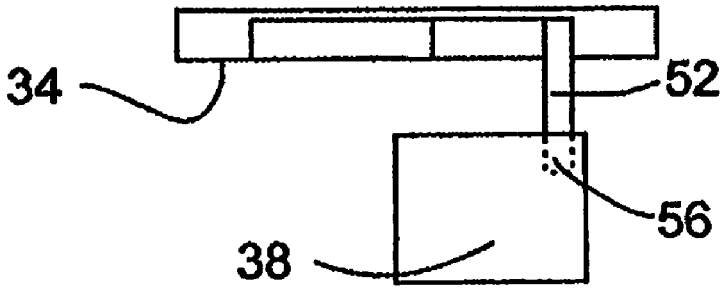
FIG. 16 illustrates a tool as shown in FIG. 15 but with the magnet rotated to a second position.

Referring now to FIG. 15, the post 52 may be moved so that the magnet 38 is in a first position wherein the length of the magnet extends inward towards the center of the first leg 30. Referring now to FIG. 16, thereafter the second magnet 38 may be rotated to a second position wherein the second substantially flat face 40 may engage one of the first face 20 or second face 22 of the skate blade 18 and wherein the first substantially flat reference face 34 may engage at least one of the first edge 24 or second edge 26 of the skate blade 18.

Figure 18:
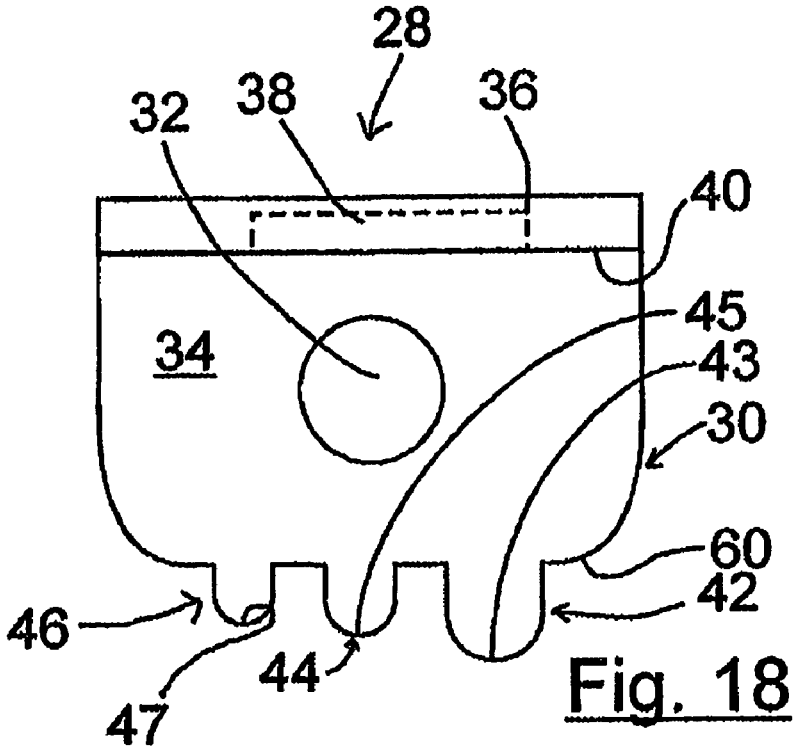
FIG. 18 is a top view of the tool shown in FIG. 17.
Figure 17:
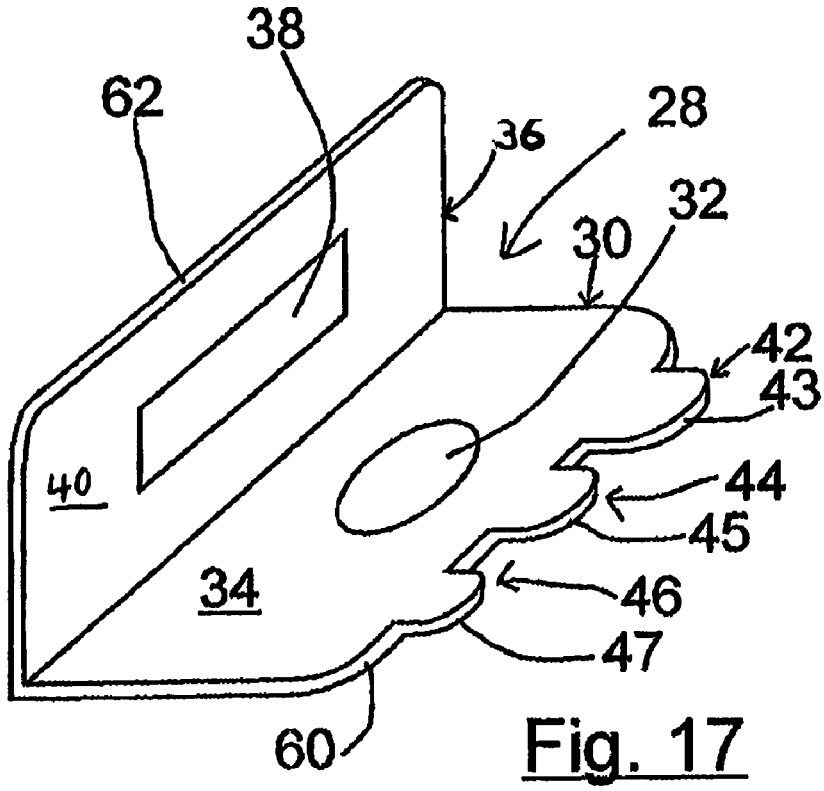
FIG. 17 is a perspective view of another embodiment of the invention including a tool for qualitatively measuring a feature of a skate blade having a plurality of radius of hollow indicator means extending outwardly from a side edge of a first leg of the tool.

FIG. 17 illustrates another embodiment of the invention including a means for qualitatively determining whether a skate blade has been sharpened properly including both a means for determining whether a skate blade has been sharpened squarely, and at least one radius of hollow indicator means. In this embodiment, the tool 28 includes a plurality of radius of hollow indicator means 42, 44, 46 extending outwardly along a side edge 60 of the first leg 30 of the tool 28. The second leg 36 may include a second substantially flat reference face 40 and a side edge 62. FIG. 18 is a plan view of the tool 28 shown in FIG. 17.

Figure 20:
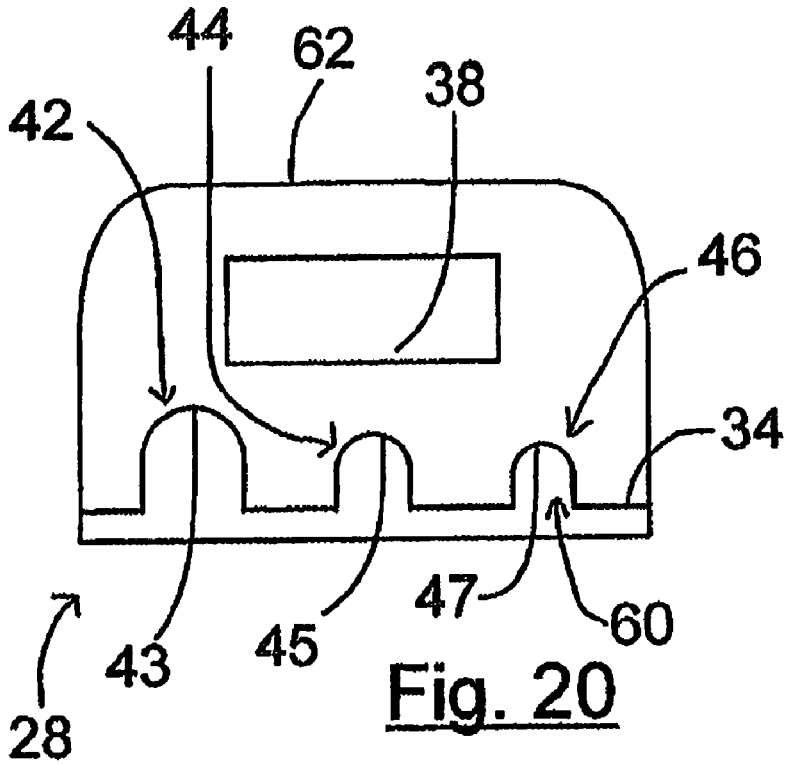
FIG. 20 is a side view of a tool according to one embodiment of the invention.
Figure 19:
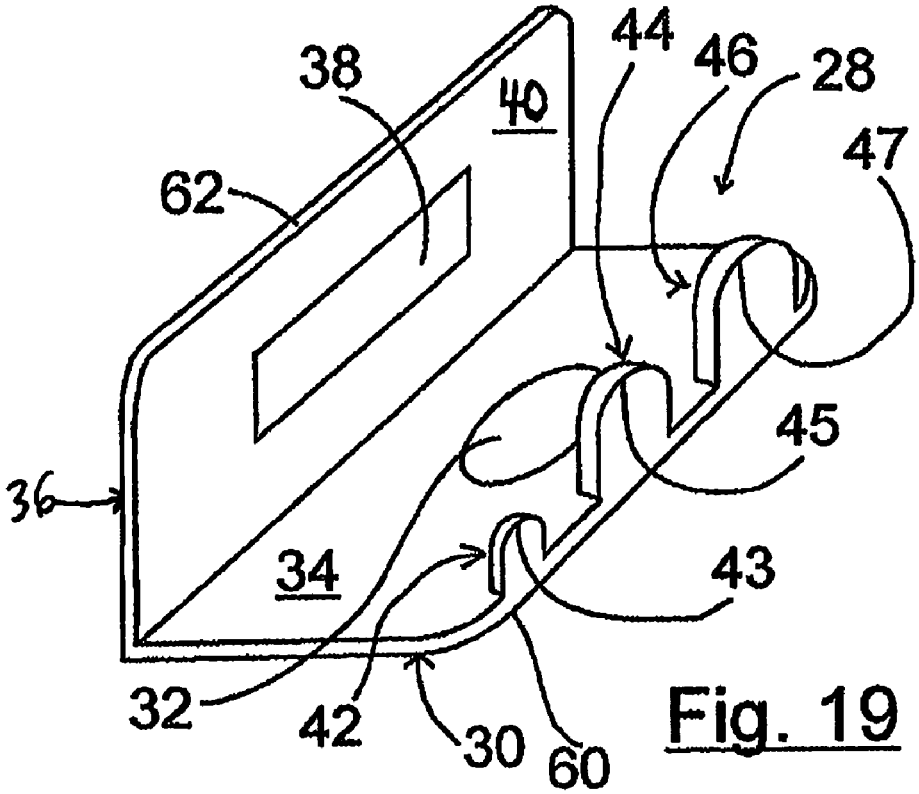
FIG. 19 is a perspective view of another embodiment of the invention including a tool for qualitatively measuring a feature of a skate blade having a plurality of radius of hollow indicator means extending out of the plane of a first reference face of a first leg of the tool.

FIG. 19 is a perspective view of another embodiment of the invention including a means for qualitatively determining whether a skate blade has been sharpened properly including both a means for determining whether a skate blade has been sharpened squarely, and at least one radius of hollow indicator means. In this embodiment, the tool 28 includes a plurality of radius of hollow indicator means 42, 44, 46 extending out of the plane of the first substantially flat face 34 of the first leg 30. FIG. 20 is a side view of another embodiment illustrating a means for qualitatively determining whether a skate blade has been sharpened properly including both a means for determining whether a skate blade has been sharpened squarely, and at least one radius of hollow indicator means. As will be appreciated from FIGS. 2, 17 and 19, the radius of hollow indicator means 42, 44, 46 may be formed at any of a variety of locations on the tool 28. A tool 28 according to the present invention may also be used to determine if the blade edges 24, 26 are worn and the blade 18 needs to be sharpened again. In one embodiment of the invention, the tool 28 is relatively inexpensive and is constructed and arranged to be carrier in a pocket of a pair of pants, coat or shirt.

Figure 21:
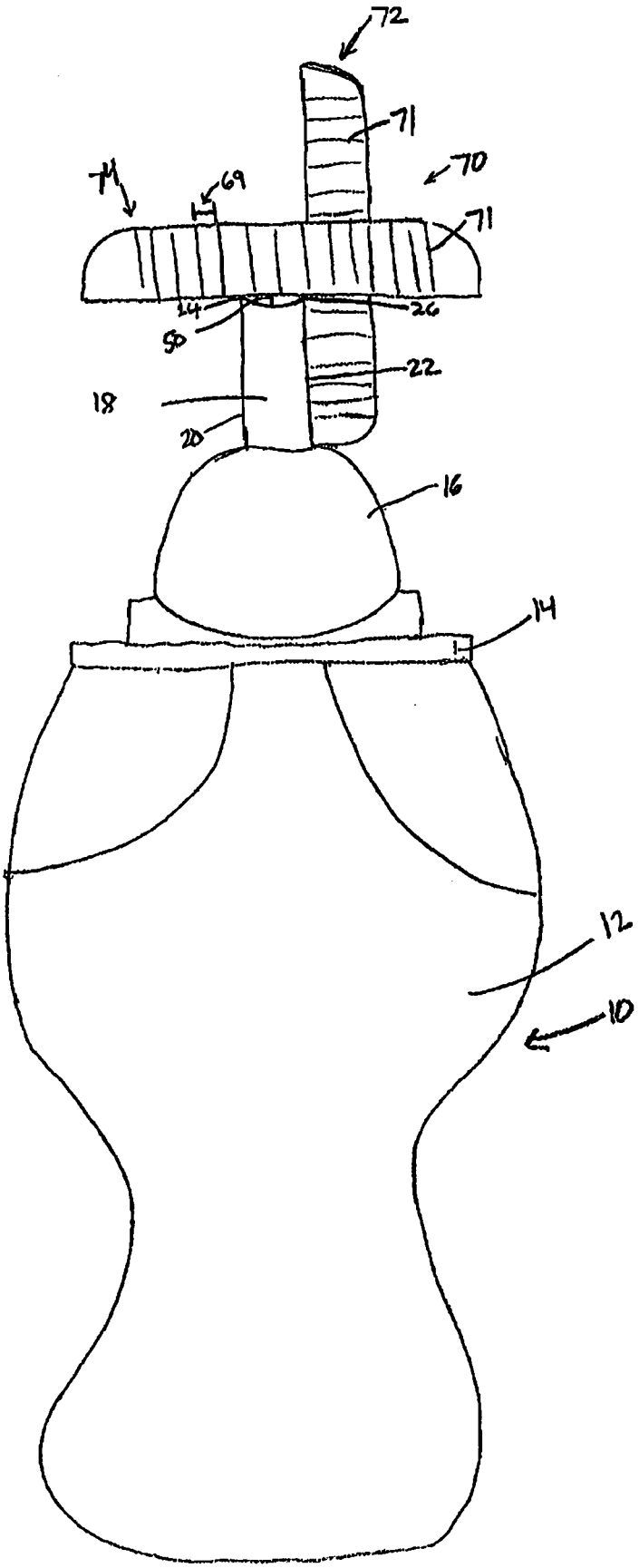
FIG. 21 illustrates a skate having a blade and a tool including a first piece and a second piece for qualitatively measuring a feature of the skate blade, according to one embodiment of the invention.

FIG. 21 illustrates a skate 10 including a boot 12 and a sole 14 attached thereto. A blade holder 16 is attached to the sole 14 by rivets (not shown) and a blade 18 is attached to the blade holder 16. Blade 18 typically includes a metal such as stainless steel and has a first side face 20 and an opposite second side face 22. Blade 18 includes a surface 50 for sharpening and skating thereon. Surface 50 is typically hollow ground to provide a first sharp edge 24 at the free end of the first face 20 of the blade and a second sharp edge 26 at the free end of the second face 22 of the blade 18. According to one embodiment of the invention, a tool 70 for qualitatively measuring a feature of the skate blade including both a means for determining whether a skate blade has been sharpened squarely, and at least one radius of hollow indicator means. The tool 70 is positioned to qualitatively measure whether the hollow ground sharpening of the surface 50 of the blade 18 has been properly centered with respect to the blade 18. The tool 70 may include a first piece 72 and a second piece 74. The first piece 72 and the second piece 74 may be constructed and arranged to balance on the skate blade 18. The first piece 72 and the second piece 74 may be made of any of a variety of materials including, but not limited to, metal, wood, plastic, thermoset and other polymeric materials. The means for determining whether a skate blade has been sharpened squarely on each of the first piece 72 and the second piece 74 may include level indicators 71. The level indicators 71 may include parallel markings or grooves on one face of each of the first piece 72 and the second piece 74. The markings or grooves may be three dimensional or they may be comprise lines formed, for example, with colored dye or paint. The level indicators 71 may be spaced evenly apart. The distance 69 between one level indicator and the next level indicator may be about 0.25 mm to about 4 mm. For example, the distance 69 may be 1 mm.

Figure 22A:
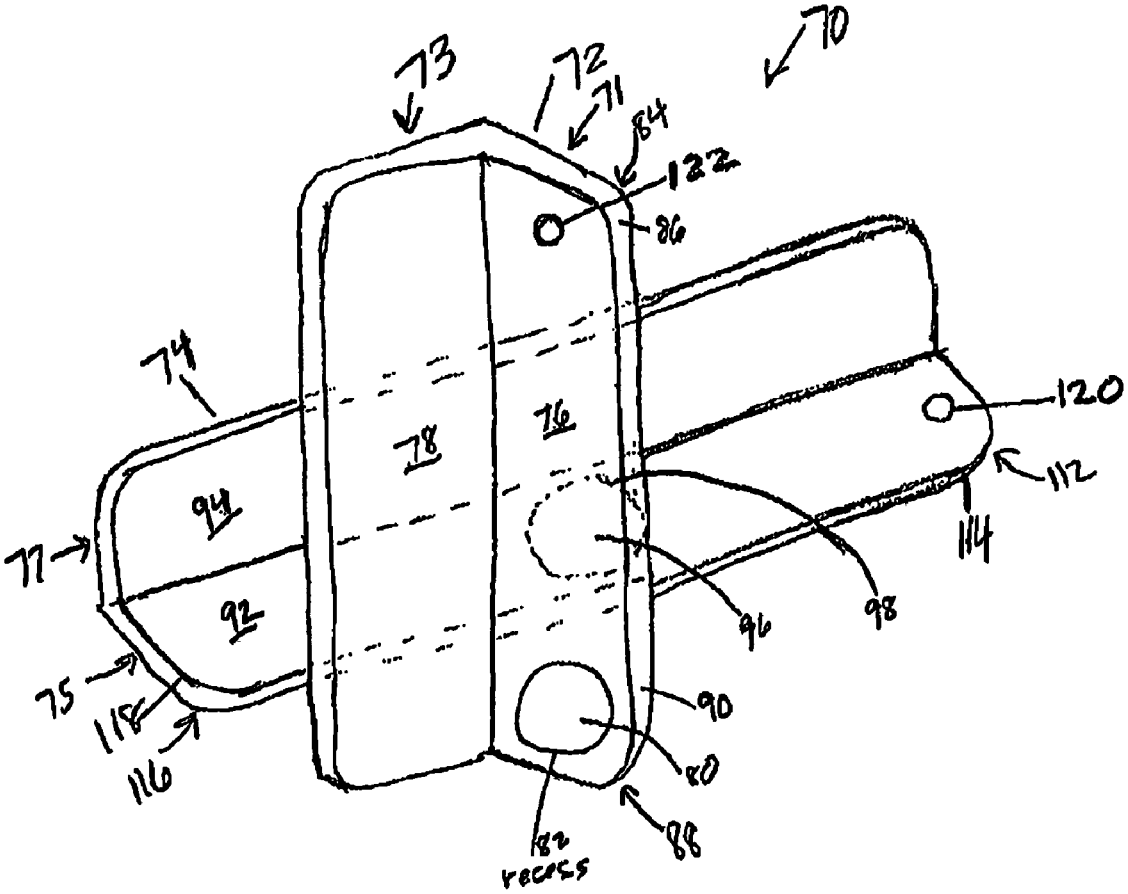
FIG. 22A is a perspective view of another embodiment of the invention including a tool including a first piece and a second piece.

Referring now to FIG. 22A, one embodiment of the invention includes a tool for qualitatively measuring a feature of a skate blade including both a means for determining whether a skate blade has been sharpened squarely, and at least one radius of hollow indicator means. The tool 70 includes a first piece 72 and a second piece 74. The first piece 72 may have a first leg 71 and a second leg 73. The first leg 71 has a first substantially flat reference face 76, and the second leg 73 has a second substantially flat reference face 78. The first substantially flat reference face 76 and the second substantially flat reference face 78 form a right angle, that is are positioned perpendicular to each other but not necessarily engaging each other. The dimensions of the first reference face 76 may be about 0.25 inch to 1.5 inches in width and about 2 inches to about 6 inches in height, and the dimensions of the second reference face 78 may be about 0.25 inch to 1.5 inches in width and about 2 inches to about 6 inches in height. In this embodiment, a first magnet 80 is received in a first recess 82 so that a portion of the first magnet 80 forms part of the first substantially flat reference face 76. Alternatively, the first magnet 80 may be embedded in the first leg 71. The first leg 71 may include a first radius of hollow indicator means 84 which may include a side edge surface 86 formed in an arcuate shape. The first radius of hollow indicator means 84 may be formed, for example, at a first corner of the first leg 71. The radius of the arcuate shaped edge surface 86 may be a first length corresponding to a first predetermined (or reference) radius of hollow. A marking (such as a number or writing) may be provided on the tool adjacent the first radius of hollow indicator means 84 to indicate the size of the radius of hollow or radius of hollow) to be qualitatively measured by the first radius of hollow indicator means 84. Similarly, a second radius of hollow indicator means 88 may be formed at a second corner of the first leg 71 and includes a side edge surface 90 formed in an arcuate shape. The radius of the arcuate shaped surface 90 is equal to or substantially the same as the radius of a second predetermined radius of hollow. The first leg 71 may include a first through-hole 120 over the first substantially flat reference face 76. A key chain or loop may extend through the through-hole 120. In another embodiment (not shown), at least one of the second leg 73 or the fourth leg 77 may include the first through-hole 120.

Also referring to FIG. 22A, the second piece 74 may have a third leg 75 and a fourth leg 77. The third leg 75 has a third substantially flat reference face 92, and the fourth leg 77 has a fourth substantially flat reference face 94. The third substantially flat reference face 92 and the fourth substantially flat reference face 94 form a right angle, that is are positioned perpendicular to each other but not necessarily engaging each other. The dimensions of the third reference face 92 may be about 0.25 inch to 1.5 inches in width and about 2 inches to about 6 inches in height, and the dimensions of the fourth reference face 94 may be about 0.25 inch to 1.5 inches in width and about 2 inches to about 6 inches in height. In this embodiment, a second magnet 96 is received in a second recess 98 so that a portion of the second magnet 96 forms part of the third substantially flat reference face 92. Alternatively, the second magnet 96 may be embedded in the third leg 75. The third leg 75 may include a third radius of hollow indicator means 112 which may include a side edge surface 114 formed in an arcuate shape. The third radius of hollow indicator means 112 may be formed, for example, at a third corner of the third leg 75. The radius of the arcuate shaped edge surface 114 may be a third length corresponding to a third predetermined (or reference) radius of hollow. A marking (such as a number or writing) may be provided on the tool adjacent the third radius of hollow indicator means 112 to indicate the size of the radius of hollow or radius of hollow) to be qualitatively measured by the third radius of hollow indicator means 112. Similarly, a fourth radius of hollow indicator means 116 may be formed at a fourth corner of the third leg 75 and includes an edge surface 118 formed in an arcuate shape. The radius of the arcuate shaped surface 118 is equal to or substantially the same as the radius of a fourth predetermined radius of hollow. The third leg 75 may include a second through-hole 122 over the third substantially flat reference face 92. A key chain or loop may extend through the through-hole 122. A user may attach the tool 70 to a key chain loop or to laces on a pair of ice skates, for example. The tool 70 may be constructed and arranged to be carried in a pocket of a shirt, coat or pair of pants.

Figure 22B:
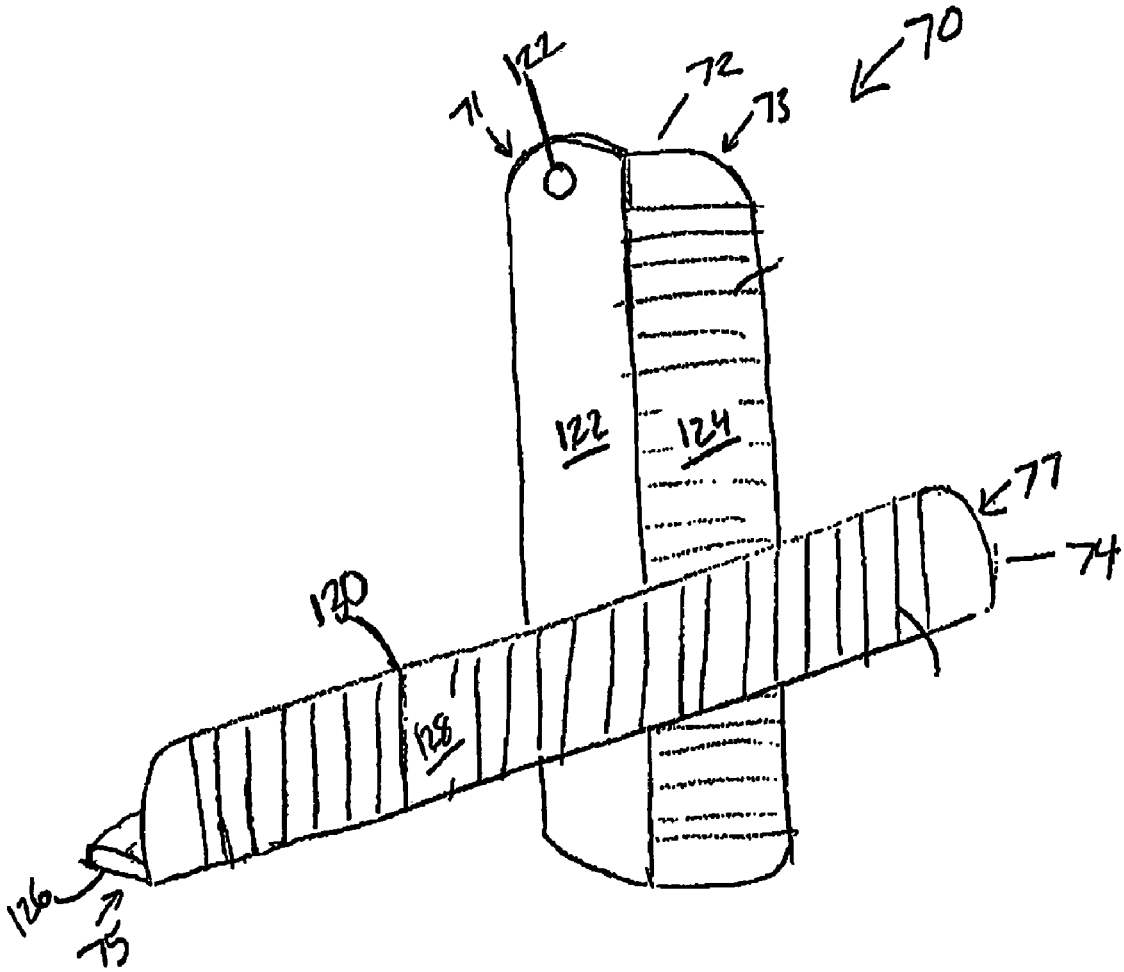
FIG. 22B is a perspective view of another embodiment of the invention including a tool including a first piece and a second piece.

FIG. 22B illustrates the tool of FIG. 22A from a different perspective. The first piece 72 has a first leg 71 and a second leg 73. The first leg 71 has a fifth substantially flat reference face 122, and the second leg 73 has a sixth substantially flat reference face 124. The fifth substantially flat reference face 122 and the sixth substantially flat reference face 124 form a right angle, that is are positioned perpendicular to each other but not necessarily engaging each other. The level indicators 71 may be provided on the fourth reference face 77 of the first leg 72.

Still referring to FIG. 22B, the second piece 74 has a third leg 75 and a fourth leg 77. The third leg 75 has a seventh substantially flat reference face 126, and the fourth leg 77 has an eighth substantially flat reference face 128. The seventh substantially flat reference face 126 and the eighth substantially flat reference face 128 form a right angle, that is are positioned perpendicular to each other but not necessarily engaging each other. The fourth leg 77 has a side edge 130 adjacent to the eighth substantially flat reference face 128. Level indicators 71 may be provided on the eighth substantially flat reference face 128. The tool 70 may be manually moved along the entire blade 18 of the skate by the user, for example from toe to heel, in order to determine if the blade 18 is level. The level indicators 71 will assist the user in determining if the blade 18 is level. For example, if the side edge 130 of the fourth leg 77 is parallel to the level indicators 71 of the second leg 73, then the blade may be substantially level.

Figure 23A:
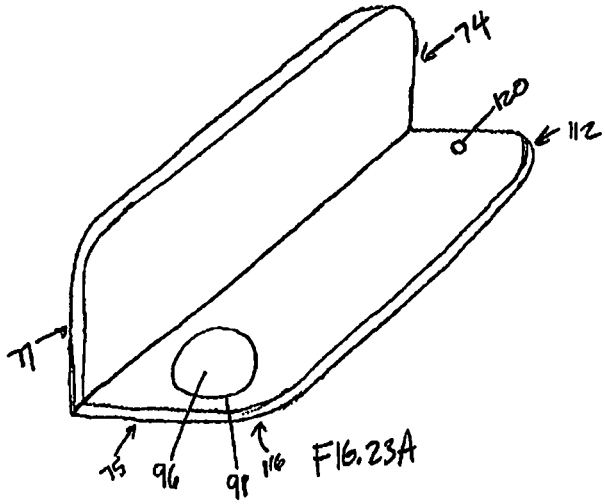
FIG. 23A is a perspective view of another embodiment of the invention including a second piece of a tool for qualitatively measuring features of the skate blade having a magnet in a first position.
Figure 23B:
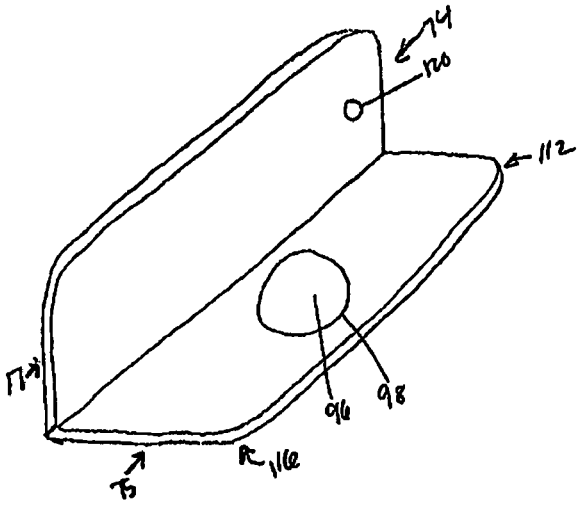
FIG. 23B is a perspective view of another embodiment of the invention including a second piece of a tool for qualitatively measuring features of the skate blade having a magnet in a second position.
Figure 23C:
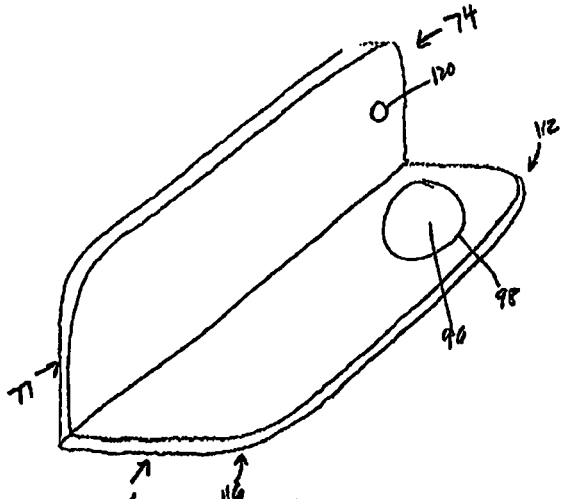
FIG. 23C is a perspective view of another embodiment of the invention including a second piece of a tool for qualitatively measuring features of the skate blade having a magnet in a third position.

Referring now to FIGS. 23A, 23B and 23C, the location of the second magnet 96 in the second recess 98 in the second piece 74 may vary. The location of the through-hole 120 in the second piece 74 may also vary. Referring now to FIG. 23A, the second magnet 96 may be located in a first position which may be near the fourth radius of hollow indicator means 116 of the third leg 75. For example, the second magnet 96 may be located at a position along the length of the third leg 75 so that a portion of the third leg 75 extends above the skate blade 18 and above the first piece 72 as shown in FIG. 21. The through-hole 120 may be located near the third radius of hollow indicator means 112 of the third leg 75. Referring now to FIG. 23B, the second magnet 96 may be located in a second position in the third leg 75 and the through-hole 120 may be located in the fourth leg 77. The second position of the magnet should be such that the second piece 74 may balance on the skate blade 18 so that the second piece 74 is in a perpendicular position with respect to the skate blade 18, as shown in FIG. 21. Referring now to FIG. 23C, the second magnet 96 may be located in a third position near the third radius of hollow indicator means 112. In another embodiment, the location of the first magnet 80 in the first leg 71 of the first piece 72 may also vary in the same fashion.

The term "qualitatively measuring" as used herein means to measure the quality of a feature of the skate blade but without making a quantitative or numeral measurement. For example, the radius of hollow indicator means 42 may be used to determine whether or not a skate has be sharpened to a predetermined radius of hollow. The radius of hollow indicator means 42 is used to determine if the sharpened blade has a radius of hollow that matches the predetermined radius of hollow associated with the radius of hollow indicator means 42. If the profile of the sharpened surface 50 of the blade does not match the edge surface 43 of the radius of hollow indicator means 42, then the sharpened skate blade does not have the predetermined radius of hollow, but no numeral measurement of what the actual radius of hollow of the sharpened skate blade is make or provided by the tool 28. Similarly, the tool 28 may be used to determine the quality of the sharpened blade in terms of whether the blade has been sharpened squarely or not. The tool 28 is used simply to indicate that the skate has been sharpened squarely or that the skate has not been sharpened squarely. The tool 28 does not quantitatively measure the deep of hollow or radius of hollow, nor does the tool 28 quantitatively measure the vertical position of either of the first edge 24 or second edge 26 of the skate blade 18.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A tool for qualitatively measuring a feature of a skate blade comprising:

a first leg having a first substantially flat reference face;

a second leg having a second substantially flat reference face;

wherein at least one of the first leg and the second leg comprises a first magnet;

wherein the first substantially flat reference face and the second substantially flat reference face form a right angle;

wherein the first leg and the second leg are constructed and arranged to balance on a skate blade, a plurality of radius of hollow indicator means; and wherein each of the first leg and the second leg has a length of about 2 inches to about 6 inches.

2. A tool as set forth in claim 1 further comprising a second magnet, and wherein the first leg includes the first magnet, and wherein the second leg includes the second magnet.

3. A tool as set forth in claim 2 wherein the second leg includes a second recess formed therein and wherein the second magnet is received in the second recess.

4. A tool as set forth in claim 3 wherein the second leg comprises a polymeric material.

5. A tool as set forth in claim 1 wherein the first leg has a first recess formed therein and wherein the first magnet is received in the first recess.

6. A tool as set forth in claim 5 wherein the first leg comprises a polymeric material.

7. A tool as set forth in claim 1 wherein the second leg comprises a rod having a first end connected to the first leg and a second end of the rod connected to the first magnet.

8. A tool as set forth in claim 7 wherein the first end of the rod is pivotally connected to the first leg and the second end of the rod is pivotally connected to the first magnet.

9. A tool as set forth in claim 8 wherein the first leg includes a pocket constructed and arranged to receive the rod and the first magnet.

10. A tool as set forth in claim 1 wherein the second leg comprises the first magnet and wherein the first magnet is connected directly to the first leg.

11. A tool as set forth in claim 1 wherein the second leg consists essentially of the first magnet and wherein the first magnet is connected directly to the first leg.

12. A tool as set forth in claim 1 further comprising a radius of hollow indicator means.

13. A tool as set forth in claim 1 wherein the first leg comprises a first corner and a second corner, and wherein the first corner has a first arcuate shaped side edge surface, and wherein the radius of the first arcuate shaped side edge surface corresponds to a first predetermined radius of hollow skate surface profile, and the second corner comprising an second arcuate shaped side edge surface, and wherein the radius of the second arcuate shaped side edge surface corresponds to a second predetermined radius of hollow skate surface profile.

14. A tool as set forth in claim 1 wherein the plurality of radius of hollow means extend outwardly from a side edge of the first leg.

15. A tool as set forth in claim 1 wherein the plurality of radius of hollow means extend outwardly from the first substantially flat reference face of the first leg.

16. A tool for qualitatively measuring a feature of a skate blade comprising: a first leg comprising a plurality of radius of hollow indicator means extending outwardly along a side edge of the first leg and further comprising a second leg, and wherein the first leg comprises a first substantially flat reference face, and wherein the second leg comprises a second substantially flat reference face, and wherein the first substantially flat reference and the second substantially flat reference face form a right angle.

17. A tool as set forth in claim 16 wherein the first leg further comprises a first magnet.

18. A tool as set forth in claim 16 wherein at least one of the first leg and the second leg further comprises a first magnet.

19. A tool as set forth in claim 16 wherein the first leg further comprises a first magnet, and wherein the second leg further comprises a second magnet.

20. A tool for qualitatively measuring a feature of a skate blade comprising:

a first leg having a first substantially flat reference face, and a second leg having a second substantially flat reference face, and wherein the first leg comprises a first magnet and the second leg comprises a second magnet, and wherein the first substantially flat face and the second substantially flat reference face form a right angle, and wherein at least one of the first leg and second leg comprises a plurality of radius of hollow indicator means.

21. A tool as set forth in claim 20 wherein each of the first leg and second leg comprises a polymeric material.

22. A tool as set forth in claim 21 wherein the tool is constructed and arranged to be carried in a pocket of a shirt, coat or pair of pants.

23. A tool comprising:

a means for qualitatively determining whether a skate blade has been sharpened properly comprising a radius of hollow indicator means comprising a first leg having a first flat face and a second leg having a second flat face, and wherein the first flat face and second face are formed at a right angle, the first leg comprising at least one arcuate shaped side edge, and a first magnet.

24. A tool as set forth in claim 23 further comprising a second radius of hollow indicator means.

25. A tool for qualitatively measuring a feature of a skate blade comprising:

a first leg having a first substantially flat reference face, and a second leg having a second substantially flat reference face, and wherein the first leg comprises a first magnet and the second leg comprises a second magnet, and wherein the first substantially flat reference face and the second substantially flat reference face form a right angle;

wherein the first leg further comprises first radius of hollow indicator means comprising a first corner, and wherein the first corner has a first arcuate shaped side edge surface, and wherein the radius of the arcuate shaped first side edge surface corresponds to a first predetermined radius of hollow skate surface profile, and first leg further comprising a second radius of hollow indicator means comprising a second corner comprising an arcuate shaped second side edge surface, and wherein the radius of the arcuate shaped second side edge surface corresponds to a second predetermined radius of hollow skate surface profile;

the tool being constructed and arranged to measure if a skate blade has been sharpened squarely, wherein the skate blade comprises a first side face, an opposite second side face, wherein the first side face of the skate blade terminates at a first edge and the second side face terminates at a second edge, and a concaved sharpened surface between the first edge and second edge;

the first leg and the second leg being constructed and arranged so that the first substantially flat reference face may be placed flush with a first side face of a skate blade and so that the second substantially flat reference face engages only one of the first edge and second edge if the skate has not been sharpened squarely with respect to the first side face and second side face of the skate, and so that the second substantially flat reference face engages both of the first edge and second edge if the skate has been sharpened squarely with respect to the first side face and second side face of the skate;

and the tool being constructed and arranged to measure if a skate blade has been sharpened to a first predetermined radius of hollow or a second predetermined radius of hollow, wherein the arcuate shaped first side edge surface may be placed over the concaved surface of the skate blade and if the arcuate shaped first side edge surface matches the profile of the concave surface the skate blade has the first predetermined radius of hollow associated with the first radius of hollow indicator means, and if the arcuate shaped first side edge surface does not match the profile of the concave surface the skate blade does not have the first predetermined radius of hollow;

and wherein the arcuate shaped second side edge surface may be placed over the concaved surface of the skate blade and if the arcuate shaped second side edge surface matches the profile of the concave surface the skate blade has the second predetermined radius of hollow associated with the second radius of hollow indicator means the skate has and if the arcuate shaped second side edge surface does not match the profile of the concave surface the skate blade does not have the second predetermined radius of hollow.

26. A tool for qualitatively measuring a feature of a skate blade comprising:

a first piece having a first leg having a first substantially flat reference face, and a second leg having a second substantially flat reference face, and wherein at least one of the first leg and the second leg comprises a first magnet, and wherein the first substantially flat reference face and the second substantially flat reference face form a right angle;

a second piece having a third leg having a third substantially flat reference face, and a fourth leg having a fourth substantially flat reference face, and wherein at least one of the third leg and the fourth leg comprises a second magnet, and wherein the third substantially flat reference face and the fourth substantially flat reference face form a right angle; and wherein the first piece and the second piece are constructed and arranged to balance on a skate blade, wherein the first leg further comprises a fifth substantially flat reference face, the second leg further comprises a sixth substantially flat reference face, the third leg further comprises a seventh substantially flat reference face, and the fourth leg further comprises an eighth substantially flat reference face, wherein the sixth substantially flat reference face comprises level indicators, wherein the eighth substantially flat reference face comprises level indicators, and wherein the first leg comprises a first corner and a second corner of the first leg, and wherein the first corner has a first arcuate shaped side edge surface, and wherein the radius of the first arcuate shaped side edge surface corresponds to a first predetermined radius of hollow skate surface profile, and the second corner comprising a second arcuate shaped side edge surface, and wherein the radius of the second arcuate shaped side edge surface corresponds to a second predetermined radius of hollow skate surface profile.

27. A tool as set forth in claim 26 wherein the level indicators comprise at least one of markings, grooves, or lines.

28. A tool as set forth in claim 26 wherein the distance between each level indicator and the adjacent level indicator is about 0.25 mm to about 4 mm.

29. A tool as set forth in claim 26 wherein the first leg includes the first magnet.

30. A tool as set forth in claim 29 wherein the third leg includes the second magnet.

31. A tool as set forth in claim 30 wherein the third leg has a second recess formed therein and wherein the second magnet is received in the second recess.

32. A tool as set forth in claim 29 wherein the first leg has a first recess formed therein and wherein the first magnet is received in the first recess.

33. A tool as set forth in claim 26 wherein the first piece comprises a polymeric material.

34. A tool as set forth in claim 26 wherein the second piece comprises a polymeric material.

35. A tool as set forth in claim 26 further comprising a radius of hollow indicator means.

36. A tool as set forth in claim 26 further comprising a plurality of radius of hollow indicator means.

37. A tool as set forth in claim 26 wherein at least one of the first leg, second leg, third leg, or fourth leg further comprises a through-hole.

38. A tool as set forth in claim 26 wherein the tool is constructed and arranged to be carried in a pocket of a shirt, coat or pair of pants.

39. A tool as set forth in claim 26 wherein the third leg comprises a third corner and a fourth corner, and wherein the third corner has a third arcuate shaped side edge surface, and wherein the radius of the third arcuate shaped side edge surface corresponds to a third predetermined radius of hollow skate surface profile, and the fourth corner comprising a fourth arcuate shaped side edge surface, and wherein the radius of the fourth arcuate shaped side edge surface corresponds to a fourth predetermined radius of hollow skate surface profile.

40. A tool for qualitatively measuring a feature of a skate blade comprising:

a first piece having a first leg having a first substantially flat reference face, and a second leg having a second substantially flat reference face, and wherein at least one of the first leg and the second leg comprises a first magnet, and wherein the first substantially flat reference face and the second substantially flat reference face form a right angle;

a second piece having a third leg having a third substantially flat reference face, and a fourth leg having a fourth substantially flat reference face, and wherein at least one of the third leg and the fourth leg comprises a second magnet, and wherein the third substantially flat reference face and the fourth substantially flat reference face form a right angle;

wherein the first piece and the second piece are constructed and arranged to balance on a skate blade; and further comprising a plurality of radius of hollow indicator means.

41. A tool as set forth in claim 40 wherein the level indicators comprise at least one of markings, grooves or lines.

* * * * *

UNITED STATES PATENT AND TRADEMARK OFFICE

CERTIFICATE OF CORRECTION

PATENT NO. : 7,434,324 B2
APPLICATION NO. : 11/701594
DATED : October 14, 2008
INVENTOR(S) : James McKenna It is certified that error appears in the above-identified patent and that said Letters Patent is hereby corrected as shown below:

In the patent, column 5, line 60 after "now" insert --to--

In the patent, column 7, line 44 after "to be" delete "carrier" and insert --carried--

In the patent, column 8, line 7 after "may" delete "be"

In the patent, column 10, line 14 after "has" delete "be" and insert --been--

In the patent, column 11, line 23 after "comprising" delete "an" and insert --a--

Signed and Sealed this

Sixth Day of October, 2009

David J. Kappos

David J. Kappos
*Director of the United States Patent and Trademark Office*